United States Patent [19]

Rabus et al.

[11] 4,140,085

[45] Feb. 20, 1979

[54] METHOD AND APPARATUS FOR CORRECTING SENSOR OUTPUT SIGNAL

[75] Inventors: Friedrich Rabus, Schwieberdingen; Hartmut Schweizer, Korntal-Muchingen, both of Fed. Rep. of Germany

[73] Assignee: Robert Bosch GmbH, Stuttgart, Fed. Rep. of Germany

[21] Appl. No.: 799,490

[22] Filed: May 23, 1977

[30] Foreign Application Priority Data

May 22, 1976 [DE] Fed. Rep. of Germany ..... 2623018
Oct. 29, 1976 [DE] Fed. Rep. of Germany ..... 2649272

[51] Int. Cl.[2] ..... F02B 3/08; F01N 3/08

[52] U.S. Cl. ..... 123/32 EE; 123/32 EA; 60/276; 60/285

[58] Field of Search ..... 123/32 EE, 32 EA, 119 EC; 60/276, 285

[56] References Cited

U.S. PATENT DOCUMENTS

| | | | |
|---|---|---|---|
| 3,745,768 | 7/1973 | Zechnall et al. | 60/276 |
| 3,831,564 | 8/1974 | Schmidt et al. | 123/32 EE |
| 3,911,884 | 10/1975 | Moriya et al. | 123/119 EC |
| 4,007,589 | 2/1977 | Neidhard et al. | 60/276 |
| 4,029,061 | 6/1977 | Asano | 132/32 EE |

*Primary Examiner*—Charles J. Myhre
*Assistant Examiner*—P. S. Lall
*Attorney, Agent, or Firm*—Edwin E. Greigg

[57] ABSTRACT

A method and apparatus for use with fuel mixture preparation systems which employ an oxygen sensor in the exhaust line to determine the composition of the combustible mixture supplied to the engine and which adjust the mixture on the basis of the bi-valued signals from the sensor. In order to permit the use of these signals at lower than normal operating temperatures, where the internal resistance of the sensor is high and the output signal is skewed, the invention proposes generating a correction current which is passed through the sensor and which causes a voltage drop which symmetrizes the output voltage so that the two branches of the output signal always lie respectively above and below a fixed set-point voltage, thus permitting control loop processing.

A circuit is also described which supplies the correcting current by comparison of the DC level of the output signal with the set-point value in a secondary feedback loop.

7 Claims, 8 Drawing Figures

METHOD AND APPARATUS FOR CORRECTING SENSOR OUTPUT SIGNAL

BACKGROUND OF THE INVENTION

The invention relates to a method and an apparatus for controlling the proportion of fuel and air in a combustible fuel-air mixture fed to an internal combustion engine. More particularly, the invention relates to an apparatus in which an oxygen sensor (λ-sensor) monitors the exhaust gas composition and generates a signal which is used in influencing the fuel-air ratio. For this purpose, the sensor signal is compared with a set-point or threshold value.

Known in the art are systems which determine the duration of fuel injection control pulses by disposing in the exhaust system a λ-sensor which generates an electrical signal that alternates abruptly between a higher and lower voltage depending on whether the mixture fed to the engine is rich or lean. This output signal is used as the actual value in a control loop and is used by the fuel injection system to determine the duration of the control pulses used to actuate the injection valves. The basic duration of the fuel injection control pulses is determined on the basis of two major variables, i.e., the engine rpm and the air flow rate aspirated by the engine. The fuel injection control pulses are generated in synchronism with crankshaft rotations. In this previously proposed system, an attempt is made to maintain the λ control in the critical temperature domain, where the sensor has a very high internal resistance and is capable only to generate signals which are substantially shifted in voltage, by permitting the threshold or set-point voltage with which the sensor output is compared to follow the changing sensor potential. In this process, however, considerable non-linearities are produced. It is also particularly disadvantageous that aging an a dispersion of the characteristics of the sensor make the adjustment and the control process very difficult in this critical temperature domain.

OBJECT AND SUMMARY OF THE INVENTION

It is a principal object of the present invention to provide a fuel injection system with a method and an apparatus to permit reliable controlled operation of the fuel injection system even at relatively low oxygen sensor temperatures. It is a further object of the invention to provide a circuit for carrying out this method which is simply constructed and relatively inexpensive. Yet another object of the invention is to provide a method and an apparatus which permits the engine warm-up with λ control and with favorable exhaust gas compositions. Yet another object of the invention is to provide a method and an apparatus for comparing the sensor voltage with a fixed set-point threshold, thereby preventing a dependence of changes in the characteristics of the sensor due to aging or dispersion. These and other objects are attained according to the invention by providing a method and an apparatus in which the proportion of fuel and air in a fuel-air mixture is controlled by providing an oxygen sensor which generates an actual value signal and by further providing a closed control loop which permits a precise adjustment of the proportions of the fuel-air ratio. The invention provides that the changing internal resistance of the λ-sensor is monitored and that the λ-sensor is supplied with a changing current so as to linearize the output voltage generated by the λ-sensor and to counteract any distortion in the output voltage. The invention then provides a comparison of the sensor output voltage with an opposing comparison voltage. A special circuit responds to the changing DC voltage from the sensor and supplies an appropriate compensation current to the sensor.

The invention will be better understood as well as further objects and advantages thereof become more apparent from the ensuing detailed description of two preferred exemplary embodiments of the invention taken in conjunction with the drawing.

DESCRIPTION OF THE PREFERRED EMBODIMENTS

Figure 1:
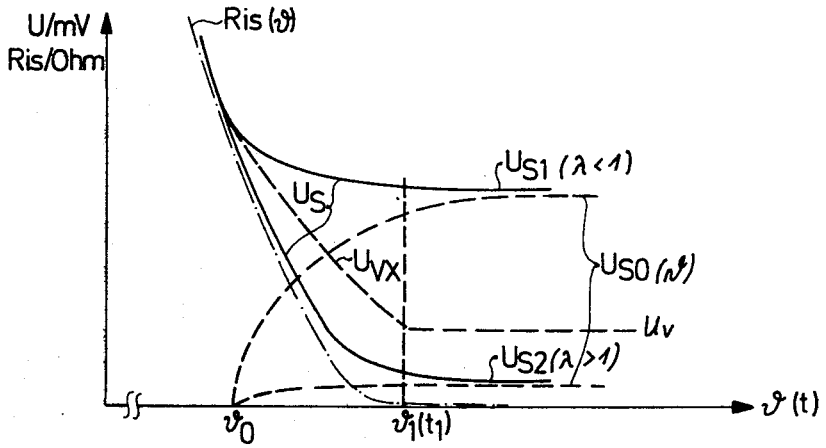
FIG. 1 is a diagram illustrating the sensor output voltage and the internal sensor resistance as a function of temperature and of time in the case of engine warm-up.

FIG. 1 is an illustration of the behavior of the output voltage and the internal resistance of the λ-sensor as a function of temperature or time if applicable. The λ-sensor or oxygen sensor to which this invention relates is a sensor disposed in a suitable location within the exhaust system of an internal combustion engine. If this sensor is sufficiently hot it is capable of sensing the composition of the exhaust gas depending on the presence or absence of oxygen and thereby indicate whether the combustible mixture fed to the engine is lean or rich. The λ-sensor indicates these conditions by producing an output voltage which alternates between, for example, 100 mV for a lean mixture and approximately 900 mV for a rich mixture. A signal of this type which alternates between two values may be readily used for controlling the mixture fed to the engine by employing the engine itself as the controlled path while the fuel injection system acts as the controller and the λ-sensor provides the actual value of the system.

Figure 1A:
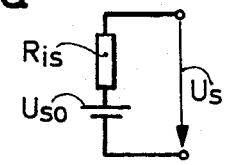
FIG. 1*a* is the equivalent circuit of the λ-sensor.

When the λ-sensor is at lower than normal operating temperature or is cold, its ability to distinguish between rich and lean mixtures completely disappears so that no closed loop control is possible due to the absence of a useable actual value signal. In an intermediate state, which in FIG. 1 would correspond to the region between $\theta_0$ and $\theta_1$, the λ-sensor is able to distinguish between a rich and a lean mixture but the use of the generated signals is quite difficult for reasons which will be discussed in more detail below. The underlying causes of the behavior of the λ-sensor in the manner described are that the internal resistance Ris (see FIG. 1*a*) is highly temperature-dependent and can rise to very large values when the λ-sensor is cold but falls to relatively low values when the operating temperature of the λ-sensor approaches approximately 250° C. By contrast, the EMF of the λ-sensor, i.e., the voltage $U_{s0}$ which it generates, is zero below a temperature $\theta_0$ and then increases with increasing temperature while splitting into two branches which relate to the external conditions surrounding the sensor, i.e., whether a lean or rich mixture had been present and whether oxygen is or is not present in the exhaust gas.

It will be appreciated that any circuit which processes the output signal from the λ-sensor will require at least a small input current. Alternatively, a deliberate monitor current may be fed to the sensor so as to permit the detection of a non-operational state. For either or both of these reasons, the voltage $U_s$ which is taken from the λ-sensor is a function both of the sensor EMF as well as of the temperature-dependent internal resistance Ris as can be seen in the illustration of FIG. 1. Approximately beginning with the temperature $\theta_1$ which during engine warm-up corresponds to a time $t_1$, the internal resistance of the oxygen sensor has dropped to a point where the sensor EMF becomes effective and the condition of rich or lean mixture may be assessed by comparing the sensor voltage $U_s$ with an opposing comparison or threshold set-point voltage $U_v$. The two voltage branches $U_{s1}$ and $U_{s2}$ of FIG. 1 are representative of the upper and lower limiting curves for the voltage $U_s$ between which the sensor output voltage alternates depending on the type of mixture fed to the engine. It will be appreciated that, in the domain where $\theta<\theta_1$, a point would be reached where even the lower sensor voltage $U_{s2}$ which indicates a lean mixture would be above a constant threshold voltage $U_v$. In order to permit continuation of the control process even in this temperature domain, it has been proposed to shift the threshold voltage $U_v$ used by the subsequent comparator by, for example, a timing element so as to place it in between the two branches, somewhat as shown by the dashed line $U_{vx}$.

The present invention proposes instead to secure λ-control at low engine or sensor temperatures without changing the fixed threshold voltage $U_v$ in the entire possible operating domain of the sensor. It had been believed until now that the behavior of the λ-sensor output voltage and its internal resistance in the critical temperature region between $\theta_0$ and $\theta_1$ had to be accepted as unalterable and attempts have been made to provide circuitry to adapt the control process to the existing conditions. The present invention departs from this view and instead provides an external current to the λ-sensor which is adapted to the output signal of the sensor and produces an anti-distortion and linearization of the output voltage of the λ-sensor in the critical temperature domain so as to obtain the values of these variables which are plotted in FIG. 2.

The total voltage $U_s$ carried by the output contacts of the λ-sensor is composed as follows:

$$U_s = U_{so}(\theta) + \mathrm{Ris}(\theta) \cdot I_{so},$$

in which $I_{so}$ is the current flowing through the sensor at any time. According to the invention, an external sensor current $I_s$ is so controlled on the basis of the temperature-dependent internal resistance Ris as to maintain the sensor voltages $U_{s1}$ and $U_{s2}$ as nearly as possible symmetrically above and below the threshold voltage $U_v$. (see FIG. 2). The curve I illustrates the actual values of the sensor voltage $U_s$ while the dashed straight line $U_v$ represents the constant threshold voltage which corresponds to the second right hand term of the above equation. The linearization of the parameters of the λ-sensor is obtained by a circuit illustrated in the diagram of FIG. 3 in which the dashed lines refer to the basic aspects of the known λ control. The sensor voltage $U_s$ which is obtained at a point P1 with respect to ground is carried through the line 2 to a customary comparator circuit which receives it at an input 4 and compares it with a constant threshold or comparison voltage $U_v$ received at an input 5. The circuit block 3 may also contain an integrator and other circuit elements for influencing the fuel-air mixture, the basic composition of which is set by the prevailing system, for example a fuel injection system, which uses engine parameters such as rpm and air flow rate to produce fuel injection control pulses of variable duration $t_i$. The methods and devices for performing this fuel injection control are known and will not be described in further detail. In any case, a feedback loop is closed via a dashed connection 6 which represents the feedback of data relating to the exhaust gas which is used for controlling the fuel-air mixture which is then sensed by the λ-sensor 7. The λ-sensor 7 is provided with a controlled sensor current $I_s$ which is introduced at the pont P1 through a line 8 in which is present a control circuit 9 which receives the λ output signal $U_s$ after passage through a low pass filter 10 and an integral controller 11, the output of which is passed through a resistor 12 to the circuit point P1. The free input 13 of the integral controller 11 receives the constant threshold voltage $U_v$ which is also supplied to the input 5 of the comparator 3 and which may be generated by any suitable means, for example with the aid of a stabilized voltage divider.

Figure 2:
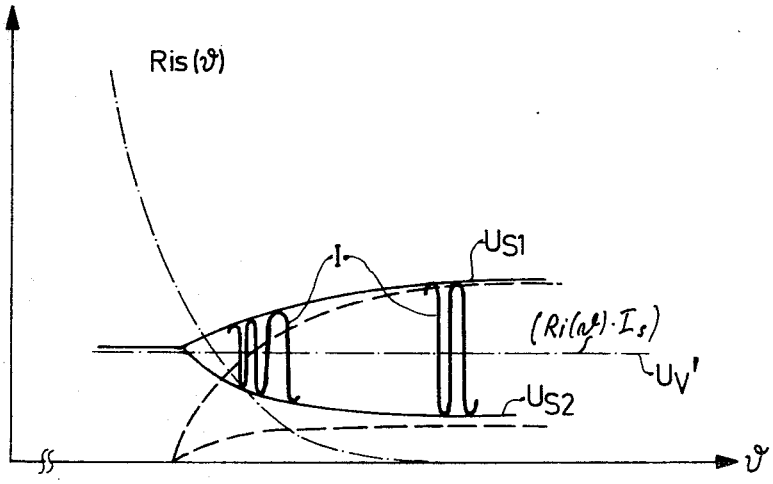
FIG. 2 is a diagram illustrating the sensor parameters as a function of temperature after linearization and removal of distortion according to the invention.
Figure 3:
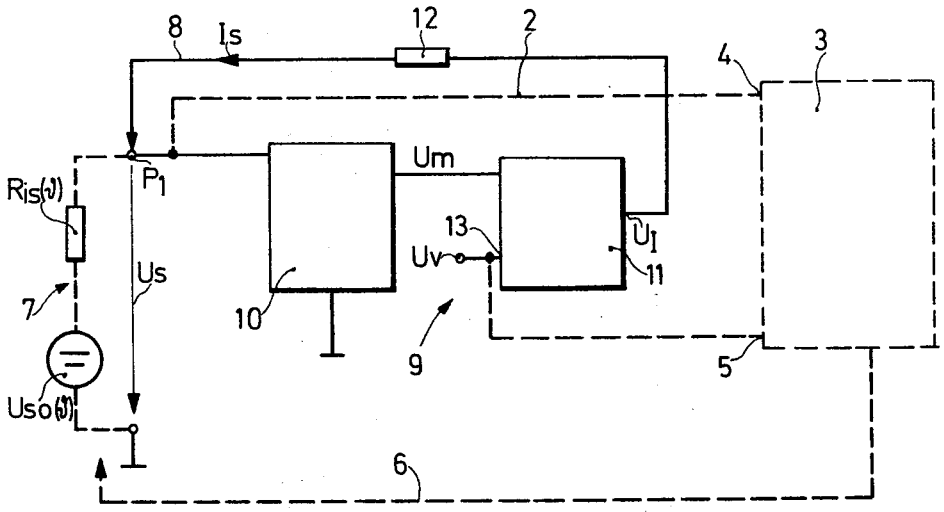
FIG. 3 is a circuit diagram of a first exemplary embodiment of the apparatus of the invention in which the dashed elements are the basic elements of λ control.
Figure 4:
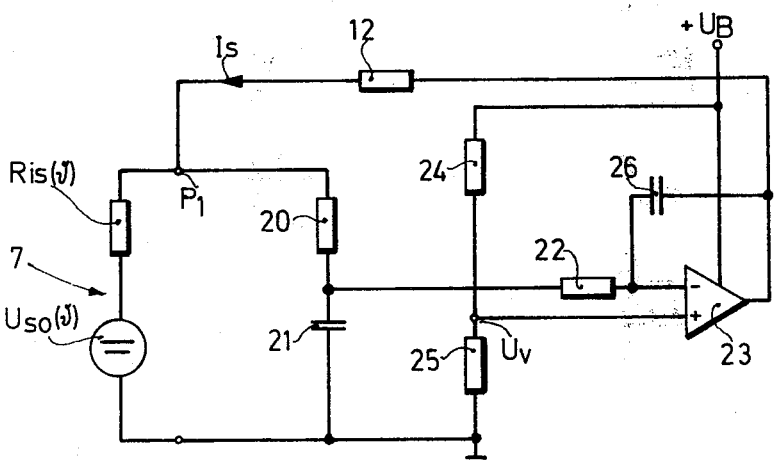
FIG. 4 is a circuit diagram of the circuitry required for changing the sensor parameters.

The circuit illustrated in FIG. 3 operates in the following manner. The rapid sensor voltage fluctuations illustrated by the curve I of FIG. 2 are filtered out by the low pass filter 10 so that the subsequent controller 11 only receives the DC component of the voltage present at the point P1 and this DC component is assumed to change only slowly. The output of the preferably integrally operating controller 11 is fed back to the point P1 through the line 8 so that the controller which compares the DC component $U_m$ with the fixed threshold voltage $U_v$ attempts to change the value of the current $I_s$ until the DC component of the voltage present at P1, i.e., the voltage $U_m$, is equal to the fixed threshold voltage $U_v$. This process results in the linearization or anti-distortion or symmetrization of the sensor voltage behavior as shown in FIG. 2 and thus permits opration at a constant threshold voltage $U_v$. A preferred but only exemplary embodiment of the internal construction of the circuit element 9 of FIG. 3 is shown in FIG. 4. In this current, the low pass filter 10 is an RC element consisting of a resistor 20 connected in series with a capacitor 21, both of which are connected in parallel with the sensor 7. The junction of the resistor 20 and the capacitor 21 is connected through a resistor 22 to the inverting input of an operational amplifier 23 which constitutes the controller 11. The non-inverting input of the operational amplifier 23 receives the constant threshold voltage $U_v$ which, in this case, is provided by a voltage divider consisting of resistors 24 and 25 which are connected between the two available voltage sources. A capacitor 26 connected across the output and the inverting input of the operational amplifier 23 provides it with integrating characteristics. The time constant of the control process described must be such that it is slow enough to permit rapid variations of the sensor voltage $U_s$ between the limiting branches $U_{s1}$ and $U_{s2}$ to be available for use by the comparator 3 for basic λ control. On the other hand, the feedback control exerted by the controller 9 or its equivalent in FIG. 4 should be relatively rapid as compared with the basic warm-up of the λ-sensor and thus compared with the temperature-dependent change of the sensor EMF $U_{s0}$ because it is the object of changing the DC component of the voltage present at the point P1 to correspond to the behavior of the factors $U_{s0}(\theta)$ and Ris $(\theta)$. both of these operating conditions may be met however by suitable dimensioning of the low pass filter components.

The controller 11 is given integral behavior because this prevents a too rapid adjustment of the sensor current $I_s$ which would keep the required fluctuations of the voltage of the sensor from reaching the point P1.

Figure 5A:
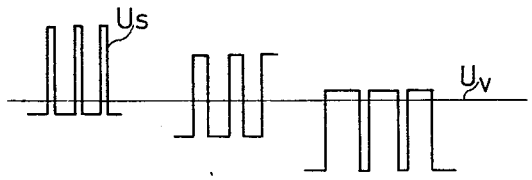
FIG. 5*a* illustrates the sensor voltage in relation to the threshold voltage in the critical region of temperature.
Figure 5B:
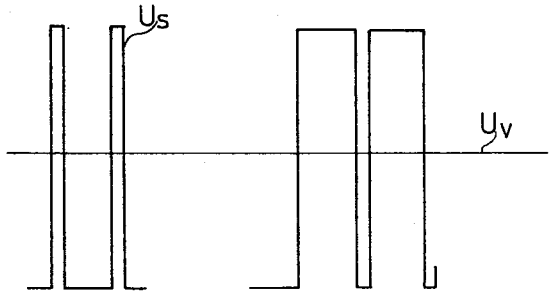
FIG. 5*b* illustrates the sensor voltage and the threshold voltage in normal operation (hot sensor)

FIG. 5*a* illustrates the sensor output voltage when the internal resistance Ris is high and FIG. 5*b* illustrates the same pulses when the internal resistance Ris is low. The difference in the amplitude is due to the changing distance between the two branches of the voltage $U_s$ when the internal resistance changes.

The illustration of FIG. 5*a* shows that the relation of the sensor voltage $U_s$ to the threshold voltage $U_v$ is also affected by the keying ratio of the oscillating sensor voltage $U_s$ (see curve I in FIG. 2). If the keying ratio is unsymmetric, the sensor output voltage $U_s$ alternates unsymmetrically about the threshold value $U_v$ because the DC component at the point P1 is equal to the threshold voltage $U_v$. The temperature range illustrated in FIG. 5*a* lies between $\theta_0$ and $\theta_1$ and that of FIG. 5*b* lies in the fully operational range where the sensor temperature is higher than the temperature $\theta_1$. At this elevated temperature, the internal resistance Ris of the sensor 7 is very low so that the circuit which provides the sensor current $I_s$ practically no longer matters because the relatively small control current $I_s$ which flows through the internal resistance Ris has no noticeable effect on the DC potential present at the point P1.

Figure 6:
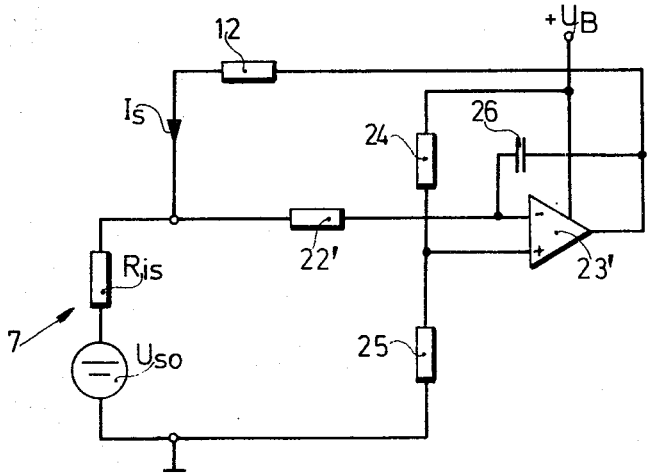
FIG. 6 is a circuit diagram of a second simplified exemplary embodiment of the invention.

FIG. 6 is a circuit diagram of a second exemplary embodiment of the invention which is simplified by the omission of the low pass filter 10 of FIG. 3. The function of this filter is taken over by the operational amplifier 23' which itself operates as a type of low pass filter. Circuit elements which remain identical to those of FIG. 4 have retained the same reference numerals and the construction and function of the embodiment of FIG. 6 will not be further described as it is very similar to that of FIG. 4. Which of these two circuits is actually used in practice depends on the desired dynamic characteristics and on the shape of the curves representing the functions Ris $= f(\theta)$ and $U_{s0} = f(\theta)$.

As already discussed, the method and apparatus of the invention may be used in association with any desired type of fuel mixture preparation system, for example those employing carburetors, fuel injection systems and the like. When carburetors are used, the nozzle cross section for fuel flow may be changed but other carburetor parameters may be altered for changing the composition of the fuel-air mixture under the control of the output signal from the λ-sensor.

The invention may also be used with advantage in controlling the exhaust gas recycle rate in fuel mixture preparation systems, for controlling the flowthrough bypass conduits or to provide additional adjustment of the duration of fuel injection control pulses in fuel injection systems, for example by influencing the multiplying stage of such systems. In general the λ-sensor and its associated components which modify and utilize its output signal may be used in any system in which fuel is aspirated by engine vacuum or is delivered to the combustion regions under pressure.

The foregoing relates to preferred exemplary embodiments and variants of the invention, it being understood that other embodiments and variations are possible within the spirit and scope of the invention.

What is claimed and desired to be secured by Letters Patent of the United States is:

1. An apparatus for controlling the composition of the fuel-air mixture for an internal combustion engine, said apparatus including sensor means for sensing the presence of oxygen in the exhaust gas, means for generating a setpoint signal, comparator means for comparing said set-point signal with said signals from said sensor and means for controlling the composition of the fuel-air mixture on the basis of said comparing, and wherein the improvement comprises:

a circuit for detecting the DC component of said signals from said sensor and for comparing said DC component with said set-point signal and for providing a current related to the difference between said DC component and said set-point signal to said sensor to thereby generate a voltage drop across the terminals of said sensor in dependence on the internal resistance thereof; whereby the two voltage levels of the signals from said sensor are symmetrized with respect to said set-point value.

2. An apparatus as defined by claim 3, wherein said circuit includes a low pass filter connected to said sensor output and having a time constant such that normal rapid changes in said sensor output due to changes in said fuel-air mixture are suppressed and that only the remaining DC potential, which slowly alters in dependence on engine or sensor temperature, is supplied to one input of a controller/comparator, the other input of which is connected to a reference DC voltage.

3. An apparatus as defined by claim 2, wherein said controller/comparator is an operational amplifier, said apparatus further comprising a capacitor connected between the output and the inverting input of said operational amplifier, thereby providing integral operational behavior.

4. An apparatus as defined by claim 3, wherein said operational amplifier has integral characteristics and constitutes said low pass filter.

5. An apparatus as defined by claim 2, wherein said low pass filter includes an RC element connected across said sensor.

6. A method for controlling the composition of a fuel-air mixture supplied to an internal combustion engine including the steps of:

providing a sensor to sense the oxygen content of the exhaust gases in said engine;

adjusting the composition of said fuel-air mixture on the basis of signals from said sensor; and wherein the improvement comprises the steps of:

supplying to said sensor an electric current the magnitude of which is such that the voltage drop thereby induced in said sensor symmetrizes the voltage of output signals from said sensor with respect to a constant potential, thereby permitting operation at lower than normal operating temperatures.

7. A method as defined by claim 6, wherein said step of supplying to said sensor an electric current comprises:

detecting the DC level of said signals from said sensor;

comparing said DC component with a constant set-point voltage;

generating a current related to the difference between said DC potential and said set-point current; and applying said current to said sensor to thereby produce a voltage drop based on the internal resistance of said sensor; whereby the product of the internal sensor resistance and said current is substantially equal to said set-point voltage.

* * * * *